US012312748B2

(12) United States Patent
Pan et al.

(10) Patent No.: US 12,312,748 B2
(45) Date of Patent: May 27, 2025

(54) PULP MOLDED PRODUCT LINE WITH ROLL FORMING FUNCTION

(71) Applicant: Shurcon Manufacturing (Zhejiang) CO., LTD., Jiaxing (CN)

(72) Inventors: Yaohua Pan, Jiaxing (CN); Junhui Hu, Jiaxing (CN); Kai Wang, Jiaxing (CN); Qingjun Hu, Jiaxing (CN); Gang Cen, Jiaxing (CN)

(73) Assignee: Shurcon Manufacturing (Zhejiang) CO., LTD., Jiaxing (CN)

( * ) Notice: Subject to any disclaimer, the term of this patent is extended or adjusted under 35 U.S.C. 154(b) by 208 days.

(21) Appl. No.: 18/122,639

(22) Filed: Mar. 16, 2023

(65) Prior Publication Data

US 2023/0228039 A1 Jul. 20, 2023

Related U.S. Application Data

(63) Continuation of application No. PCT/CN2021/117326, filed on Sep. 8, 2021.

(30) Foreign Application Priority Data

Sep. 17, 2020 (CN) ..... 202010981942.8

(51) Int. Cl.
*D21J 5/00* (2006.01)
*D21J 1/02* (2006.01)

(52) U.S. Cl.
CPC .. *D21J 5/00* (2013.01); *D21J 1/02* (2013.01)

(58) Field of Classification Search
CPC ..... D21J 5/00; D21J 3/00; D21J 1/02
See application file for complete search history.

(56) References Cited

U.S. PATENT DOCUMENTS 4,721,500 A * 1/1988 Van Handel ..... B27N 5/02 264/324
2009/0032206 A1* 2/2009 Gregory ..... D21C 5/005 162/158

(Continued)

FOREIGN PATENT DOCUMENTS

CN 211256499 U * 8/2020
WO WO-2015042874 A1 * 4/2015 ..... B29C 57/12

OTHER PUBLICATIONS

CN-211256499-U English translation retrieved from Espacenet (Year: 2024).*

*Primary Examiner* — Jacob T Minskey
*Assistant Examiner* — Elisa H Vera
(74) *Attorney, Agent, or Firm* — Hemisphere Law, PLLC; Zhigang Ma

(57) ABSTRACT

A pulp molded product line with roll forming function includes a pulp suction device, a hot pressing assembly used to perform hot pressing on a pulp sucked by the pulp suction device to obtain a hot pressed pulp molded product, an edge cutting device used to perform edge cutting on the hot pressed pulp molded product to obtain an unrolled pulp molded product; and a rolling device used to perform radially inwards rolling on the unrolled pulp molded product to obtain a pulp molded product. The advantages of the pulp molded product line with roll forming function are that the waste problem of inconsistent material thickness by rolling can be solved, the raw materials can be saved and the production and processing efficiency can be improved.

19 Claims, 9 Drawing Sheets

(56) References Cited

U.S. PATENT DOCUMENTS

2015/0292154 A1* 10/2015 Zheng ..... D21F 7/006
162/253
2020/0384671 A1* 12/2020 Hirawaki ..... B29C 43/58

* cited by examiner

PULP MOLDED PRODUCT LINE WITH ROLL FORMING FUNCTION

TECHNICAL FIELD

The disclosure relates to the technical field of pulp molded product processing, in particular to a pulp molded product line with roll forming function.

BACKGROUND

Pulp molded products includes pulp molded cup lids, pulp molded cups and other products.

When a cup lid and a cup are combined, in order to ensure the sealing performance and the anti-falling performance, an annular buckle is generally manufactured on any one of the cup lid and the cup.

At present, this annular buckle is processed in a pulp molding process to achieve the above-mentioned sealing performance and anti-falling performance. In this way, although use requirements can be met to some extent, this way has the following defects:

the structure of unequal thickness is caused, the material input amount is increased, and meanwhile, the production and processing efficiency is reduced.

SUMMARY

The objective of the disclosure is to provide a pulp molded product line with roll forming function, which can solve the above-mentioned problems.

In order to achieve the above objective, the disclosure adopts the following technical solutions.

A pulp molded product line with roll forming function includes a pulp suction device, a hot pressing assembly configured to perform hot pressing on a pulp sucked by the pulp suction device to obtain a hot pressed pulp molded product, and an edge cutting device configured to perform edge cutting on the hot pressed pulp molded product obtained after the hot pressing of the hot pressing assembly to obtain an unrolled pulp molded product, and the pulp molded product line further includes a rolling device configured to perform radially inwards rolling on the unrolled pulp molded product obtained after the edge cutting of the edge cutting device to obtain a pulp molded product; an annular convex buckle is formed on an inner wall of the pulp molded product obtained after the rolling of the rolling device, and an annular rolling groove corresponding to the annular convex buckle is formed on an outer wall of the pulp molded product.

The pulp suction device and the hot pressing assembly are used to transfer the pulp through a first robot; and the edge cutting device and the rolling device are used to transfer the unrolled pulp molded product through a second robot, so that the production efficiency is improved.

In an embodiment, the rolling device includes:

a loading unit, configured to load and convey the unrolled pulp molded product;

a rolling unit, including a horizontal rotating table; where at least one translatable rolling wheel is horizontally slidably connected to an upper surface of the horizontal rotating table, the at least one translatable rolling wheel is connected to a translation driving mechanism and a rotation driving mechanism, and the upper surface of the horizontal rotating table is rotatably connected to two rolling moving dies located at a periphery of each translatable rolling wheel and symmetrically distributed with the translatable rolling wheel as a center; each rolling moving die corresponds to a rotary pressing-down assembly, each rolling moving die corresponds to a rotary driving mechanism, the rotary driving mechanism is configured to drive the rolling moving die to rotate, the translatable rolling wheel is configured to move close to the rolling moving die, thereby to radially inwards roll the unrolled pulp molded product, and a next unrolled pulp molded product is placed on another rolling moving die; and a take-and-place unit, configured to place the unrolled pulp molded product conveyed by the loading unit on the rolling moving die, and obtain and transfer the rolled pulp molded product out of the rolling unit.

In an embodiment, the number of the rolling unit is two, the two rolling units are linearly distributed front and back at intervals, and the two rolling units are rotatably connected to a platform frame.

In an embodiment, the number of the translatable rolling wheel is multiple, and the multiple translatable rolling wheels are arranged in a row, the rotation driving mechanism is configured to drive the translatable rolling wheels to rotate synchronously, the two rolling moving dies which are symmetrically distributed with the translatable rolling wheel as the center are distributed on the periphery of each translatable rolling wheel, the rolling moving dies are arranged in two rows, the number of the rotary driving mechanism is two, and one rotary driving mechanism is configured to drive the rolling moving dies located on a same raw to rotate synchronously, and the rotary pressing-down assemblies are arranged in two rows and located on a same row act synchronously.

In an embodiment, each rotary pressing-down assembly includes: a rotating cylinder and a pressing block connected to a rotating telescopic rod of the rotating cylinder, and the pressing block is rotatably connected to the rotating telescopic rod of the rotating cylinder.

In an embodiment, the translation driving mechanism includes a translation plate which is horizontally and slidably connected with the horizontal rotating table, each translatable rolling wheel is mounted on the translation plate through a connecting shaft and the connecting shaft is rotatably connected with the translation plate, and the horizontal rotating table is provided with a translation power assembly configured to drive the translation plate to move close to the rolling moving die or move facing away from the rolling moving die.

In an embodiment, the rotation driving mechanism includes a linkage synchronous belt wound on two adjacent connecting shafts, any one connecting shaft is connected with a driving motor through an active synchronous belt, and the driving motor is fixed on one of the translation plate and the horizontal rotating table.

In an embodiment, each rotary driving mechanism includes a rotating synchronous belt wound on rolling rotating shafts connected with rolling moving dies, the rotating synchronous belt is connected to a rotating servo motor fixed on the horizontal rotating table, and a section of the rotating synchronous belt wound on the rolling rotating shafts is wavy.

In an embodiment, the rotary pressing-down assemblies on one same row and the rotary pressing-down assemblies on the other same column are arranged in a staggered manner.

In an embodiment, the number of the translatable rolling wheel is in a range from 2 to 8, and the number of the rolling moving dies arranged in one raw is in a range from 2 to 8, and the number of the rotary pressing-down assemblies arranged in one raw is in a range from 2 to 8.

In an embodiment, the number of the take-and-place unit is two, one take-and-place unit is located above the loading unit, the other take-and-place unit is located above an unloading unit, the one take-and-place unit is configured to place unrolled pulp molded products conveyed by the loading unit on the two rolling units in a one by one way, and the other take-and-place unit is configured to obtain and transfer pulp molded products rolled by the two rolling units to the unloading unit in a one by one way, the loading unit and the unloading unit are distributed in parallel, and the rolling units are located between the loading unit and the unloading unit.

In an embodiment, each take-and-place unit is installed on a gantry bracket, and a camera located at a loading end of the loading unit is arranged on an inner side of two ends of the gantry bracket; the take-and-place unit is connected to a lower side of a top of the gantry bracket through a take-and-place translation driving device, and the take-and-place translation driving device is configured to drive the take-and-place unit to translate, thereby to transfer the rolled pulp molded product to the unloading unit.

In an embodiment, each take-and-place unit includes a horizontally arranged triangular block, each corner of a lower surface of the triangular block is connected with an upper connecting block, a lower surface of each upper connecting block is connected with a connecting rod, lower ends of the connecting rods are inwards converged and connected to a lower connecting block, and a lower surface of the lower connecting block is connected with a material taking device.

As another scheme, the rolling device includes a frame, a horizontally arranged rotating table is disposed on the frame, the rotating table is connected with a rotating power device, a plurality of rolling cavity dies rotationally connected with the rotating table and configured to fix pulp molded products are installed on the rotating table, and the plurality of rolling cavity dies are distributed in a circle. The frame is provided with a support and a lifting power member installed on the support. The lifting power member is connected with a pressing block which is rotationally connected with the lifting power member, and the rotating power member drives the rotating table to rotate so that the rolling cavity dies alternately enter directly below the pressing block. The frame is provided with a lifting seat located under the rotating table and a lifting power device that drives the lifting seat to lift vertically. The lifting power device is provided with a cavity die rotation power device, the lifting power device drives the cavity die rotation power device to rise, and a clutch connection structure is connected between the cavity die rotation power device and the rolling cavity die directly under the pressing block to realize the rotation of the rolling cavity die, the frame is further provided with a rolling terrace die which is relatively distributed with the rolling cavity die directly below the pressing block. The rolling terrace die is connected with a terrace die rotation driving device and the terrace die rotation driving device is arranged on the translation driving device.

In an embodiment, the frame is provided with at least one sensor fixing block located on an outer side of the rotating power device and a position sensor fixed on one of the sensor fixing blocks, the outer side of the rotating power device is connected with the rotating positioning block with the number equal to the total number of the rolling cavity dies, the rotating power device drives the rotating positioning blocks to rotate synchronously, and when the position sensor is opposite to any one rotating positioning block, it is indicated that one rolling cavity die is located under the pressing block.

In an embodiment, the lifting seat is a rectangular frame, the cavity die rotation power device is a servo motor, the servo motor is located in the rectangular frame, an upper end of the servo motor is fixed to a top side of the rectangular frame, an output shaft of the servo motor upwards penetrates through the top side of the rectangular frame, a Y-shaped sensor is arranged on a top surface of the rectangular frame, the output shaft of the servo motor is sleeved with a linkage plate, a notch is provided on a linkage plate, and when the notch of the linkage plate enters a sensing range of the Y-shaped sensor, it is indicated that the output shaft of the servo motor rotates in place.

In an embodiment, the clutch connecting structure includes a flat connector arranged at a top of the output shaft of the servo motor, a clutch plate is connected to a lower end of each rolling cavity die, and a flat hole allowing the flat connector to be inserted is formed in a center of the clutch plate.

In an embodiment, the rotation power device is a rotary air cylinder, a rotating shaft is connected to a rotating power device, a rotating shaft base sleeved at an upper end of the rotating shaft is arranged on the frame, the rotating table is installed on an end face of the rotating shaft extended to the upper end of the rotating shaft base, a cantilever block is arranged on a side of the rotating shaft base, a support notch is formed in the cantilever block, and an output shaft of the servo motor is snapped in the support notch.

In an embodiment, the rotating table includes a strip-shaped plate, a middle position of the strip-shaped plate is fixed to an upper end face of the rotating shaft, and the rolling cavity dies are arranged at the two ends of the upper surface of the strip-shaped plate respectively.

In an embodiment, the two ends of the strip-shaped plate are respectively provided with mounting holes and the rolling cavity dies are rotatably mounted in the mounting holes, the clutch plate is located in the mounting hole, the two ends of the lower surface of the strip-shaped plate are respectively provided with a lower plate under the clutch plate, and the center of the rotating shaft base is provided with a shaft through hole, the upper end of the rotating shaft is connected with a bearing group and the bearing group is mounted in the shaft through hole, the middle position of the strip-shaped plate is fixed at the upper end of the bearing group, and the two lower plates are symmetrically arranged with the axis of the bearing group and opposite inner edges of the two lower plates are respectively provided with arc concave surfaces matching with the outer wall of the bearing group.

In an embodiment, the upper surface of the strip-shaped plate is provided with a disc plate, and an outer edge of the disc plate is provided with circular opening grooves for the rolling cavity dies to extend in a one-to-one manner.

In an embodiment, the frame includes a lower flat plate, the lower flat plate is connected with an upper flat plate through four stand columns, the lower flat plate is parallel to the upper flat plate, the rotating table is rotationally connected to the lower flat plate, the translation driving device is fixed to the upper flat plate, the lifting power device is fixed to the lower flat plate, the support is fixed to the lower flat plate, and the terrace die rotation driving device and the translation driving device are installed on the lower flat plate.

In an embodiment, the translation driving device includes a fixing groove provided on the lower flat plate and a guide rail parallel to the fixing groove, an end of the fixing groove is connected with a servo motor, and a U-shaped sliding plate closes an upper notch of the fixed groove and forms an inverted U-shape, the servo motor is connected with the U-shaped sliding plate through a driving structure arranged in the fixing groove so as to drive the U-shaped sliding plate to move in the length direction of the fixing groove, the other end of the transverse translation plate is connected with a sliding block, the sliding block is slidably connected with the guide rail, and the terrace die rotation driving device is fixed on the transverse translation plate.

In an embodiment, the upper flat plate is provided with an avoidance hole, the terrace die rotation driving device is a servo motor, and the servo motor part extends into the avoidance hole.

In an embodiment, the edge cutting device includes a horizontal rotating table, at least one translatable rotary cutter with circular shape is horizontally and slidably connected to an upper surface of the horizontal rotating table, the translatable rotary cutter with circular shape is connected with a translation driving mechanism and a rotation driving mechanism, the upper surface of the horizontal rotating table is rotatably connected with two rotary cutting moving dies located at a periphery of each translatable rotary cutter with circular shape and symmetrically distributed with the translatable rotary cutter with circular shape as a center, each rotary cutting moving die corresponds to a rotary pressing-down assembly, each rotary cutting moving die corresponds to a rotary driving mechanism, and the rotary driving mechanism is configured to drive the rotary cutting moving die to rotate, the translatable rotary cutter with circular shape moves close to one rotary cutting moving die to radially inwardly cut a pulp molded product without edge cutting, and a next pulp molded product without edge cutting is placed on another rotary cutting moving die.

Compared with the related art, advantages of the pulp molded product line with roll molding function are as follows:

- a rolling method is used to solve the waste problem of inconsistent material thickness, save raw materials and improve production and processing efficiency;
- the rotary pressing-down assembly can rotate facing away from a top of the rolling cavity die when placing the unprocessed pulp molded product to avoid collision and improve the efficiency of loading and unloading;
- alternate rolling and loading and unloading can greatly shorten the waiting time, improve the production efficiency, and can be applied to mass production and processing;
- the manufacturing cost is low; and
- mechanical loading and unloading improves the degree of automation to further improve production efficiency.

DETAILED DESCRIPTION OF EMBODIMENTS

The following are specific embodiments of the disclosure and the technical schemes of the disclosure are further described in combination with the attached drawings, but the disclosure is not limited to these embodiments.

Embodiment 1

Figure 1:
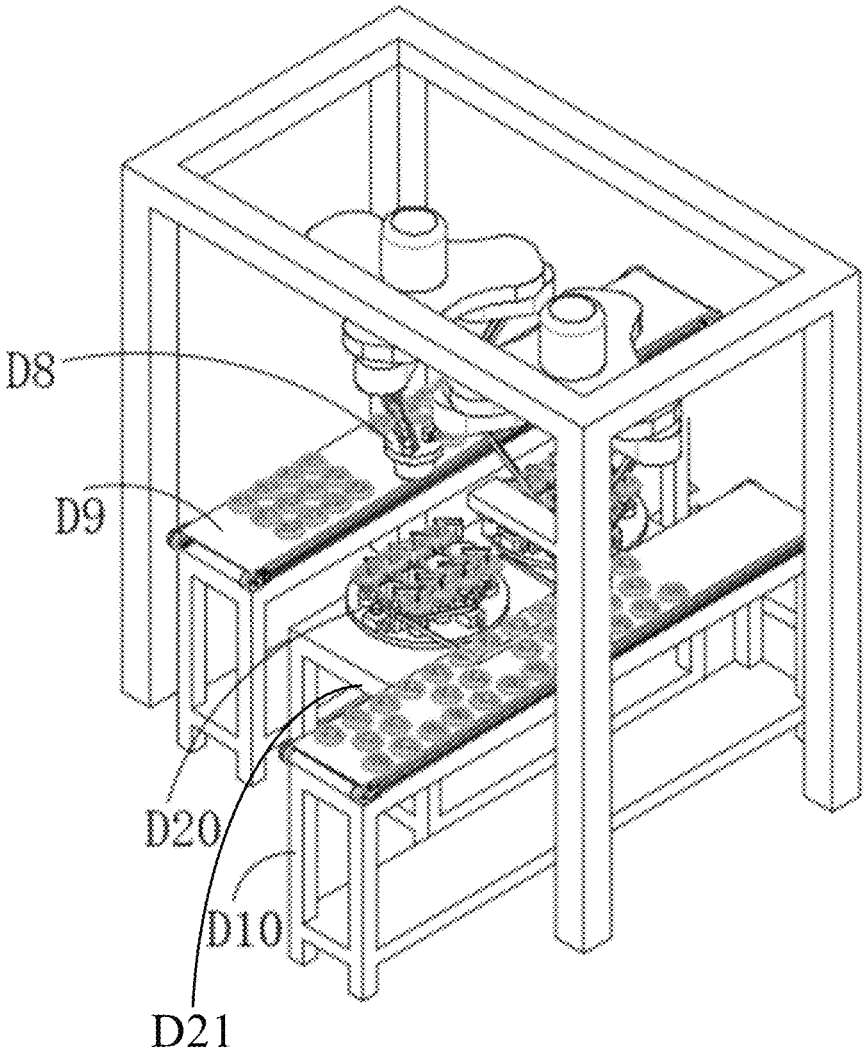
FIG. 1 illustrates a schematic structural diagram of a rolling device according to a first embodiment of the disclosure.
Figure 2:
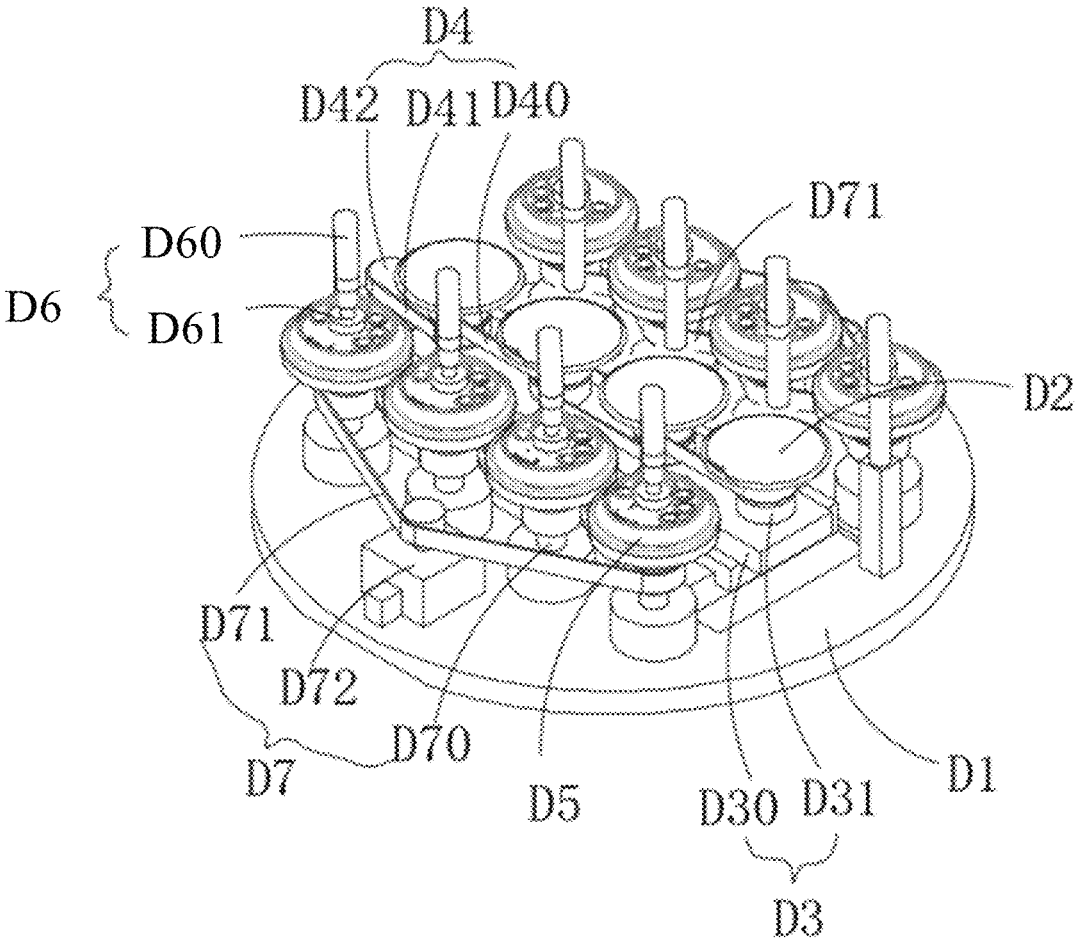
FIG. 2 illustrates a schematic structural diagram of a rolling unit according to the first of the disclosure.
Figure 11:
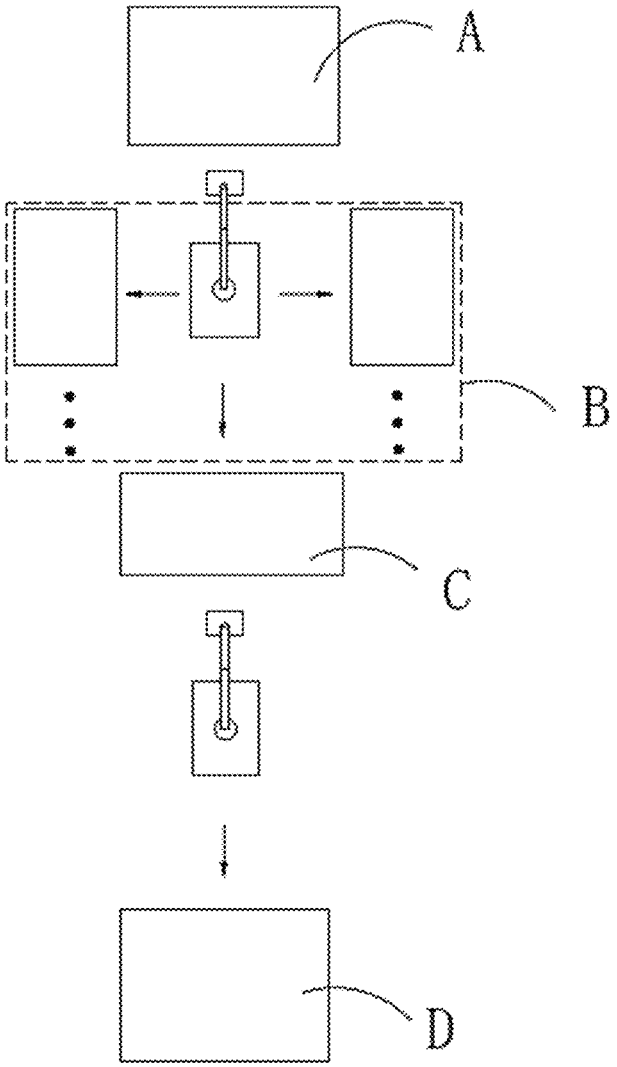
FIG. 11 illustrates a block diagram of a pulp molding product line according to some embodiments of the disclosure.

As shown in FIGS. 1-2 and 11, a pulp molding product line with roll forming function includes a pulp suction device A, a hot pressing assembly B, and an edge cutting device C. The hot pressing assembly B is used to perform hot pressing on pulps absorbed by the pulp suction device A, the hot pressing assembly B includes 1-8 hot pressing forming machines, and the hot pressing forming machines are grouped in pairs, which are relative distributed. The edge cutting device C is used to perform edge cutting on hot pressed pulp molding products obtained after the hot pressing of the hot pressing assembly B. The pulp suction device A, the hot press forming machine and the edge cutting device C are all existing devices, or the corresponding device patents previously applied by the company can be used. The pulp molding product line with roll forming function further includes a rolling device D used to perform radially inwards rolling on pulp molded products obtained after the edge cutting of the edge cutting device C. After the pulp molded products are rolled radially inwards by the rolling device D, an annular convex buckle is formed on an inner wall of the pulp molded product, and an annular rolling groove corresponding to the annular convex buckle is formed on an outer wall of the pulp molded product.

Specifically, the rolling device D includes a loading unit D10, a rolling unit D20, and a take-and-place unit D8. The loading unit D10 is used to load and convey the unrolled pulp molded products. The loading unit D10 includes a conveyor belt.

Preferably, the rolling unit D20 in this embodiment has two and two rolling units D20 are linearly distributed front and back at intervals. The two rolling unit D20 are rotationally connected to a platform frame D21. Specifically, the rolling unit D20 includes a horizontal rotating table D1, which is rotationally connected to the platform frame D21, and the platform frame D21 is provided with a rotating table driving motor D11 that drives the rotation of the horizontal rotating table 1.

The upper surface of the horizontal rotating table D1 is horizontally connected with at least one translatable rolling wheel D2. The translatable rolling wheel D2 is connected with the translation driving mechanism D3 and the translatable rolling wheel D2 is connected with the rotation driving mechanism D4. The upper surface of the horizontal rotating table D1 is rotationally connected with two rolling moving dies D5 located on the periphery of each translatable rolling wheel D2. The unprocessed pulp molded product is sleeved on the rolling moving die D5, and a lower edge of the rolling moving die D5 is provided with an annular groove which is in clearance fit with an outer edge of the translatable rolling wheel D2. The translatable rolling wheel D2 is in contact with the outer wall of the pulp molded product to force the wall thickness of the pulp molded product to roll and deform into the inside of the annular groove. That is, an inner convex buckle with the same thickness as the wall thickness of the pulp molded product is made in the direction of the wall thickness of the pulp molded product, and the rotary pressing-down assembly D6 is used to press down the unrolled pulp molded product placed on the rolling moving die D5. The rotary pressing-down assembly D6 can be rotated facing away from the top of the rolling moving die D5 when placing the unrolled pulp molded product to avoid collision and improve the efficiency of loading and unloading. The rolling moving die D5 is connected with the rotary driving mechanism D7.

The rotation direction of the rolling moving die D5 is opposite to the rotation direction of the translatable rolling wheel D2, and the rotation speeds of the rolling moving die D5 and the translatable rolling wheel D2 are the same.

Preferably, there are two rolling moving dies D5 located at the periphery of each translatable rolling wheel D2 and symmetrically distributed with the translatable rolling wheel D2 as the center in this embodiment, each rolling moving die D5 corresponds to the rotary pressing-down assembly D6, each rolling moving die D5 corresponds to a rotary driving mechanism D7, and the rotary driving mechanism D7 drives the rolling moving die D5 to rotate. Two rolling moving dies D5 can form alternate rolling and the finished pulp molded products can be taken out during the rolling, which greatly shorten the production cycle and greatly improve the production and processing efficiency. The translatable rolling wheel D2 is close to one rolling moving die D5, so as to carry out the radial inward rolling of the unrolled pulp molded products, and the next unrolled pulp molded product is placed on another rolling moving die D5.

Preferably, the translatable rolling wheel D2 in this embodiment has several and forms a row, and the rotation driving mechanism D4 drives the translatable rolling wheels 2 to rotate synchronously. That is, one rotation driving mechanism D4 drives all translatable rolling wheels D2 to rotate synchronously. There are two rolling moving dies D5 symmetrically distributed with the translatable rolling wheel D2 as the center and disposed the periphery of each translatable rolling wheel D2, and the rolling moving dies D5 are distributed in two rows. The expansion of the number can be applied to mass rolling production and processing. There are two rotary driving mechanisms D7 and one rotary driving mechanism D7 drives the rolling moving dies 5 on the same row to rotate synchronously. That is, when the unprocessed pulp molded products on one row of rolling moving dies D5 are being rolled, the other row of rolling moving dies D5 are placed on the unprocessed pulp molded products, and the waiting time is shortened by alternating, which can greatly improve the production and processing efficiency. The rotary pressing-down assemblies D6 are distributed in two rows, and the rotary pressing-down assemblies D6 on the same row act synchronously, which can be arranged conveniently and compact overall structure.

Preferably, the rotary pressing-down assembly D6 includes a rotating cylinder D60 and a pressing block D61 connected to a rotating telescopic rod of the rotating cylinder 60, and the pressing block D61 is rotationally connected with the rotating telescopic rod of the rotating cylinder D60.

The pressing block D61 and the rotating telescopic rod are rotationally connected through bearings or shaft sleeves, thus ensuring that the pulp molded products are pressed.

Furthermore, the translation driving mechanism D3 includes a translation plate D30 which is horizontally connected with the horizontal rotating table D1, two parallel guide rails are arranged on the horizontal rotating table D1, and two ends of the lower surface of the translation plate D30 are respectively provided with sliding blocks which are connected with the guide rails respectively. The above structure can realize smooth sliding of the translation plate D30. The translatable rolling wheel D2 is installed on the translation plate D30 through a connecting shaft D31 and the connecting shaft D31 and the translation plate D30 are rotationally connected. The connecting shaft D31 and the translation plate D30 can be rotationally connected through bearings or shaft sleeves. The horizontal rotating table D1 is provided with a translation power assembly that drives the translation plate D30 to move close to the rolling moving die D5 and move facing away from the rolling moving die D5. The translation power assembly is one of the air cylinder, oil cylinder and servo motor cooperative screw insert.

The translation driving mechanism D3 drives the translatable rolling wheel D2 to move close to a row of rolling moving dies D5, and then the rolling processing is carried out. At this time, the rolled pulp molded products on the other row of rolling moving dies D5 are unloaded, and the synchronous response improves the production and processing efficiency.

Furthermore, the rotation driving mechanism D4 includes a linkage synchronous belt D40 which is arranged around the two adjacent connecting shafts D31. Any one connecting shaft D31 is connected with a driving motor D42 through an active synchronous belt D41, that is, the power transmission is realized by the way of series connection. At the same time, the two adjacent active synchronous belts D41 are staggered up and down, and the driving motor D42 is fixed on the translation plate D30 or the horizontal rotating table D1. The driving motor D42 is a servo motor.

Furthermore, each rotary driving mechanism D7 includes a rotating synchronous belt D71 which is wound on the rolling rotating shafts D70 connected with the rolling moving dies D5, and the rotating synchronous belt D71 is connected with a rotating servo motor D72 fixed on the horizontal rotating table D1. A section of the rotating synchronous belt D71 wound on the rolling rotating shaft D70 is wavy, which can ensure the tension of rotating synchronous belt D71 and the timeliness of power output transmission.

Furthermore, the rotary pressing-down assemblies D6 on one same row are staggered with the rotary pressing-down assemblies D6 on the other same row. The staggered distribution can make reasonable use of space, avoid interference caused by two pairs of correspondence, and avoid the need for a larger width space.

Preferably, there are 2-8 translatable rolling wheels D2 in this embodiment; 2-8 rolling moving dies D5 are located in one row, and 2-8 rotary pressing-down assemblies D6 are located in one row.

For example, there are four translatable rolling wheels D2 in this embodiment; Four rolling moving dies D5 are located in one row, and four rotary pressing-down assemblies D6 are located in one row. During actual production, the corresponding quantity can be set according to the actual production quantity.

The translatable rolling wheels D2 on the horizontal rotating table D1 are arranged in one row, and the rolling moving dies D5 are arranged in two rows. The translatable rolling wheels D2 are close to one row of the rolling moving dies D5, while the rotary pressing-down assemblies D6 press the unprocessed pulp molded products on the rolling moving dies D5 before the translatable rolling wheels D2 are close to the rolling moving dies D5. As the translatable rolling wheels D2 are close to the rolling moving dies D5 and the translatable rolling wheels D2 and the rolling moving dies D5 rotate in the opposite directions, at this time, the translatable rolling wheel D2 rolls the pulp molded products on the rolling moving die D5 in a circumferential way, and then the translatable rolling wheel D2 resets. After the rolling, an annular convex buckle is formed on the inner wall of the pulp molded product, and an annular rolling groove corresponding to the annular convex buckle is formed on the outer wall of the pulp molded product.

At the same time of the above rolling, the rolling moving dies D5 on the other row perform unloading, that is, the rotary pressing-down assemblies D6 rotate and disengage from the rolling moving dies D5, and the unprocessed pulp molded products are placed on the rolling moving dies D5. When the rolling is completed, the horizontal rotating table D1 will rotate 180°, at this time, the translatable rolling wheels D2 are close to the unprocessed pulp molded products, and repeat the above actions to realize the repeated rolling processing.

Figure 3:
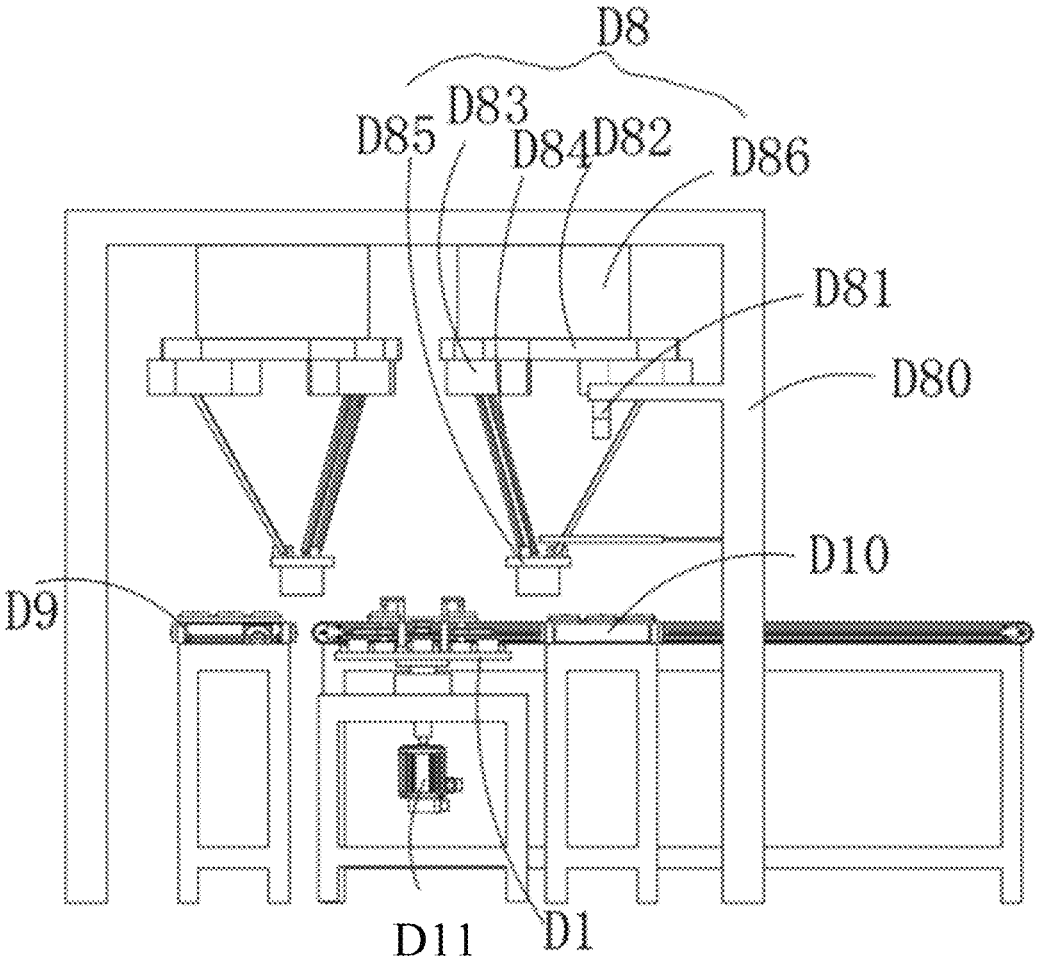
FIG. 3 illustrates a schematic structural diagram of the rolling device from another direction according to the first embodiment of the disclosure.
Figure 4:
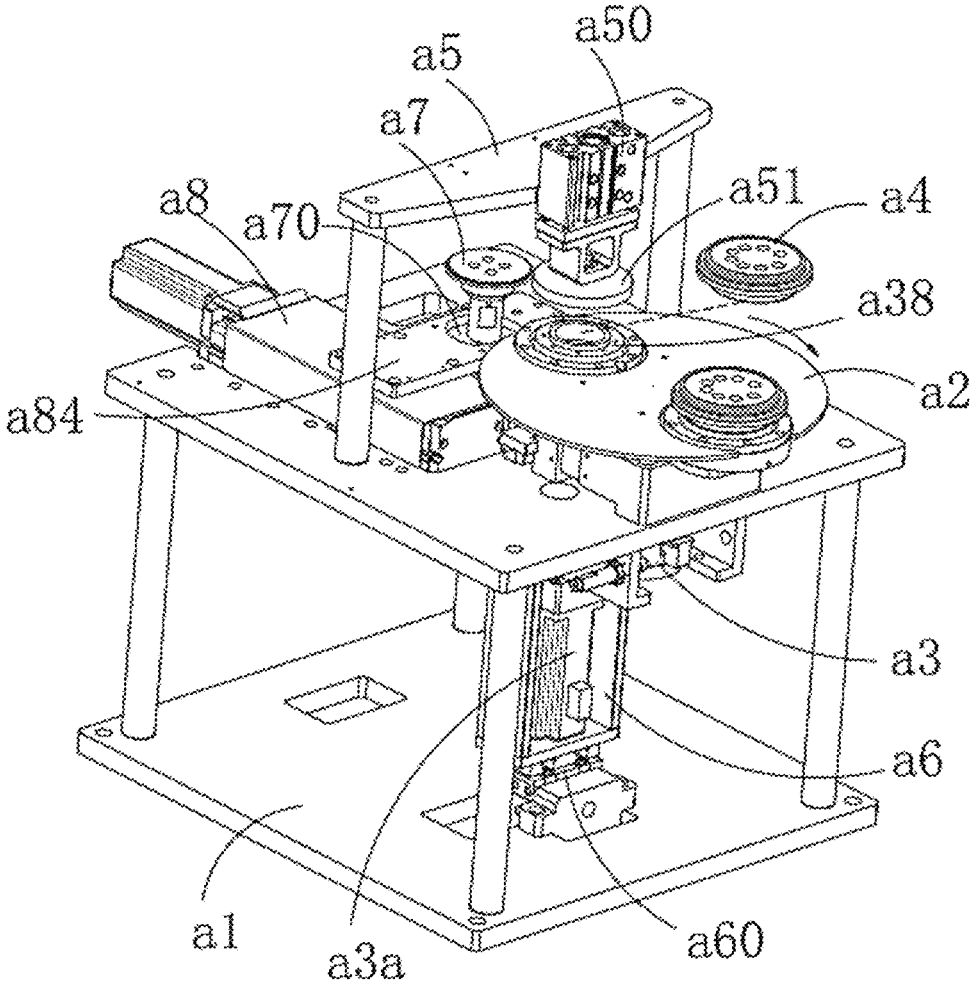
FIG. 4 illustrates a side vertical view of a rolling device according to a second embodiment of the disclosure.
Figure 5:
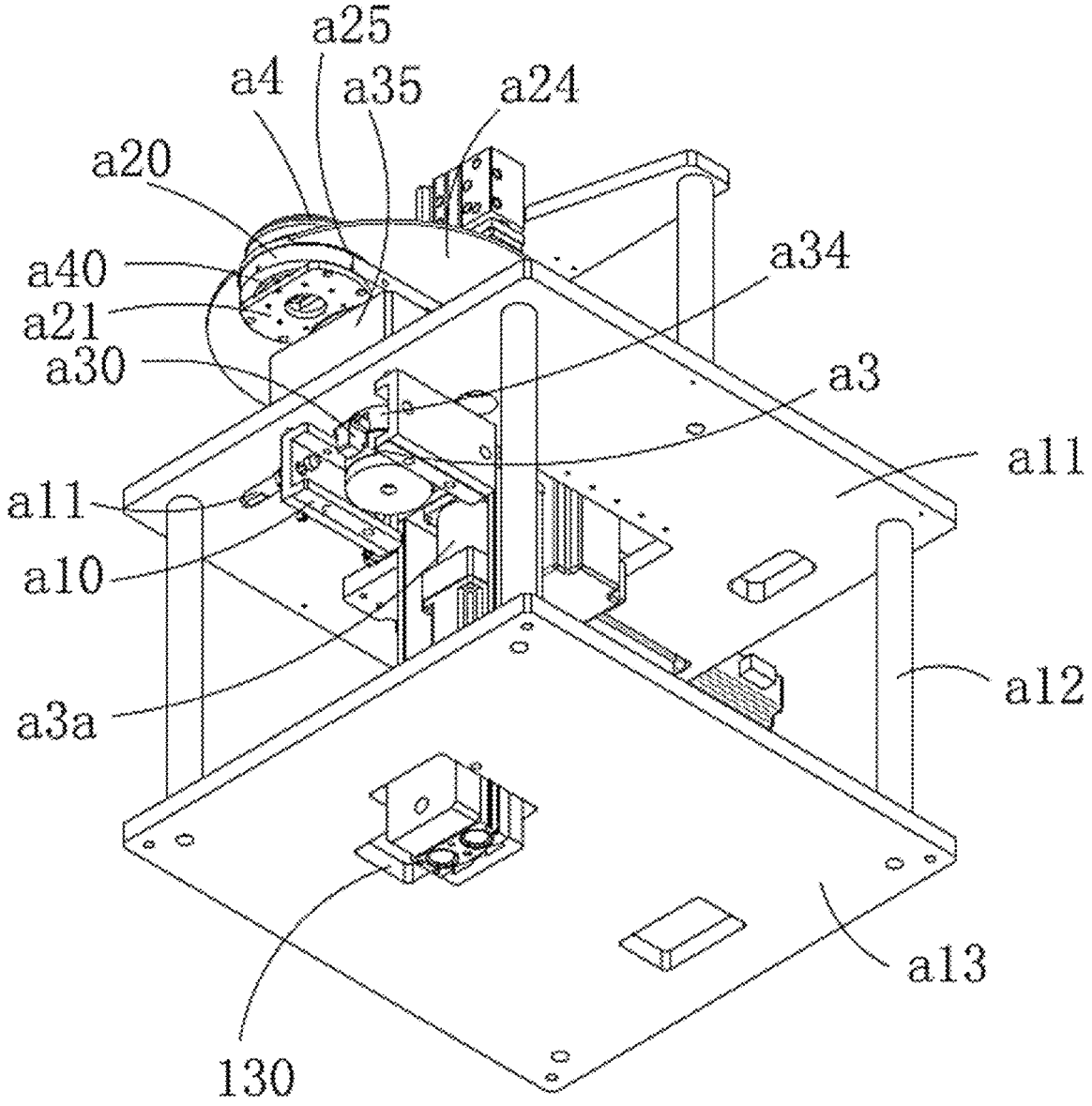
FIG. 5 illustrates a side upward view of the rolling device according to the second embodiment of the disclosure.

As shown in FIG. 3, the take-and-place unit D8 is used to place the unrolled pulp molded products conveyed by the loading unit D10 on the rolling moving dies D5, and to obtain and transfer the rolled pulp molded products to the outside of the rolling unit D20. Preferably, there are two take-and-place units D8 in this embodiment, one of which is located above the side of the loading unit D10 and the other of which is located above the side of the unloading unit D9. One of the take-and-place units D8 is used to place the unrolled pulp molded products conveyed by the loading unit D10 on the two rolling units D20 in a one by one way, the other take-and-place unit D8 is used to take and transfer the pulp molded products that have been rolled by two rolling units D20 to the unloading unit D9 in a one by one way. The loading unit D10 and the unloading unit D9 are distributed in parallel and the rolling units D20 are located between the loading unit D10 and the unloading unit D9.

Furthermore, the take-and-place unit D8 is installed on the gantry bracket D80, and a camera D81 located at a loading end of the loading unit D10 is installed on an inside of two ends of the gantry bracket D80. The camera D81 is used to detect the position of the unprocessed pulp molded products on the loading unit D10 and determine whether there is loading.

Specifically, the take-and-place unit D8 is connected to the lower side of the top of the gantry bracket D80 through a take-and-place translation driving device D86. The take-and-place translation driving device D86 drives the take-and-place unit D8 to translate, thus the rolled pulp molded products are transferred to the unloading unit D9. The take-and-place translation driving device D86 is adopted by one of the synchronous belt translation drive mode, screw nut translation drive mode and guide slide translation drive mode.

Furthermore, the take-and-place unit D8 includes a triangle block D82 arranged horizontally. Each corner of the lower surface of the triangle block D82 is respectively connected with an upper connecting block D83. The lower surface of each upper connecting block D83 is connected with a connecting rod D84, and lower ends of the connecting rods D84 converge inwards and connects to a lower connecting block D85. The lower surface of the lower connecting block D85 is connected with a material taking device. The material taking device is an air-disk lifting reclaiming device, which belongs to the prior art, and its structure will not be further described in this embodiment.

A forming method of pulp molded products includes the following steps.

S1, loading: unrolled pulp molded products are placed on the loading unit D10.

S2, placement: there are two take-and-place unit D8, one of the two take-and-place unit D8 places the unrolled pulp molded products on the rolling moving dies D5 of the rolling unit D20, and the rotary pressing-down assemblies D6 rotate and press down to fix the unrolled pulp molded products on the rolling moving dies D5.

S3, rolling: the translatable rolling wheels D2 of the rolling unit D20 move close to the rolling moving dies D5 in the step S2 and perform radial inwards rolling of the unrolled pulp molded products.

S4, unloading: the horizontal rotating table D1 of the rolling unit D20 rotates 180°, and the other take-and-place unit D8 takes the rolled pulp molded products and places them on the unloading unit D9. At this time, other rolling moving dies D5 opposite to the rolling moving dies D5 of the step S2 repeat the above step S2.

Embodiment 2

The working principle and structure of this embodiment are basically the same as that of Embodiment 1. The different structure is that, as shown in FIGS. 4-10, the rolling device includes a frame a1. Specifically, the frame a1 of this embodiment includes a lower flat plate a11. The lower flat plate a11 is connected with an upper flat plate a13 through four stand columns a12. The lower flat plate a11 and the upper flat plate a13 are parallel.

The stand columns a12 are distributed at four corners of the lower flat plate a11. Similarly, upper ends of the stand columns a12 are connected to four corners of the upper flat plate a13. A space between the lower flat plate a11 and the upper flat plate a13 can form an installation space and play a protective role.

The frame a1 is provided with a rotating table a2 which is horizontally arranged, and the rotating table a2 is connected with a rotating power device a3. Preferably, the rotating table a2 of this embodiment is rotationally connected to the upper flat plate a13. The rotating table a2 is provided with multiple rolling cavity dies a4 which are rotatably connected with the rotating table a2 and used to fix the pulp molded products. The rolling cavity dies a4 are distributed in a circle. There are two rolling cavity dies a4 in this embodiment. Of course, the number of rolling cavity dies a4 can also be 3-6, which can be designed according to the actual production requirements.

The frame a1 is provided with a support a5, which is fixed on the lower flat plate a11, and the frame a1 is further provided with a lifting power member a50 installed on the support a5, which is fixed on the lower flat plate a11, the lifting power member a50 is an air cylinder or oil cylinder, and the lifting power member a50 is connected with a pressing block a51 which is connected with the lifting power member a50 and the rotating power device a3 drives the rotating table a2 to rotate so that the rolling cavity dies a4 alternately enter directly under the pressing block a51.

The scheme of using the rotating table to cooperate with multiple rolling cavity dies a4 and make the multiple rolling cavity dies a4 enter directly under the pressing block a51 alternately can realize that one rolling station corresponds to multiple rolling cavity dies a4 alternately, so as to shorten the waiting time between the unprocessed pulp molded products and the processed pulp molded products.

As shown in FIGS. 4-7, a lifting seat a6 located under the rotating table a2 and a lifting power device a60 used to drive the vertical lifting of the lifting seat a6 are arranged on the frame a1, and a cavity die rotation power device a3*a* is arranged on the lifting seat a6. The lifting power device a60 drives the cavity die rotation power device a3*a* to rise, and a clutch connection structure is connected between the cavity die rotation power device a3*a* and the rolling cavity die a4 directly below the pressing block a51 to realize the rotation of the rolling cavity die a4. The frame a1 is further provided with a rolling terrace die a7 which is relatively distributed with the rolling cavity die a4 directly below the pressing block a51, the rolling terrace die a7 is connected with a terrace die rotation driving device a70, and the terrace die rotation driving device a70 is arranged on the translation driving device a8. The translation driving device a8 is fixed on the lower flat plate a11. The terrace die rotation driving device a70 and translation driving device a8 are installed on the lower flat plate a11.

The clutch connection structure can realize the independent rotation control of the alternately entered rolling cavity dies a4 to ensure the smoothness of the alternation, and further reduce the total number of rotating power and the input cost required for device manufacturing.

Figure 6:
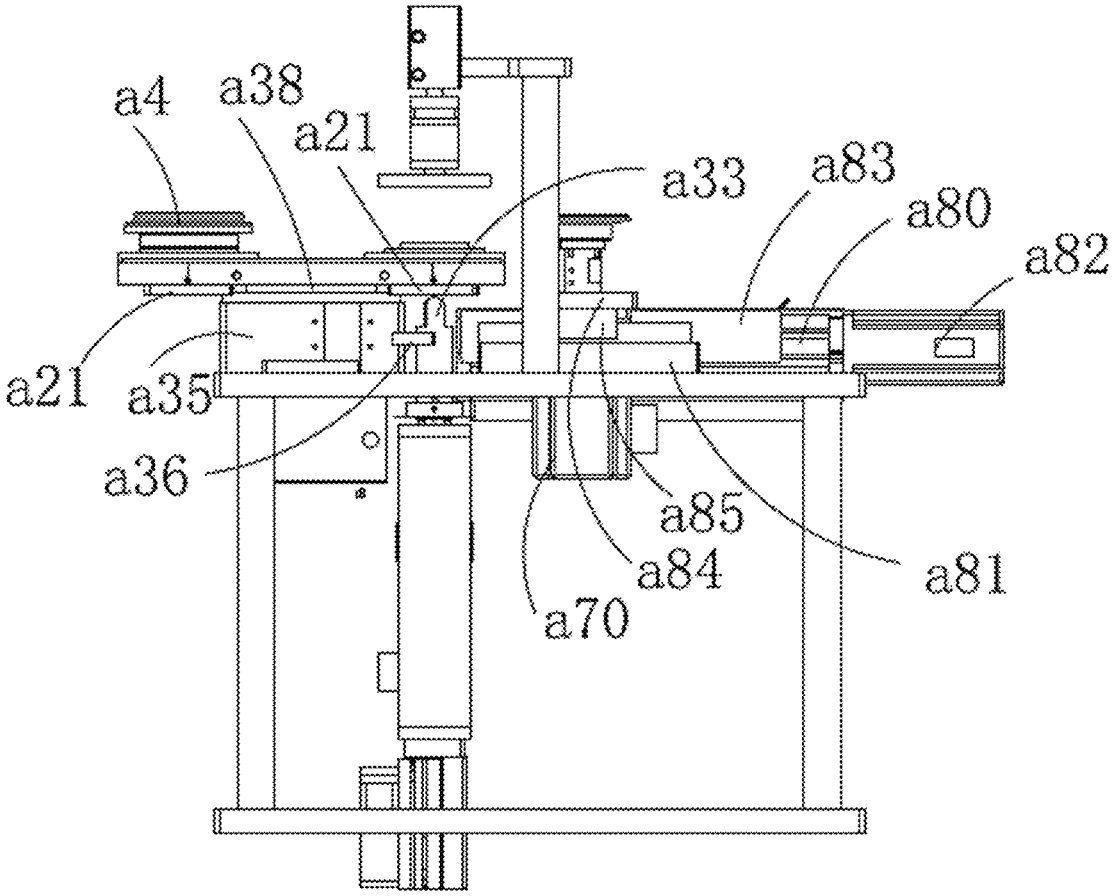
FIG. 6 illustrates a side view of the rolling device according to the second embodiment of the disclosure.
Figure 7:
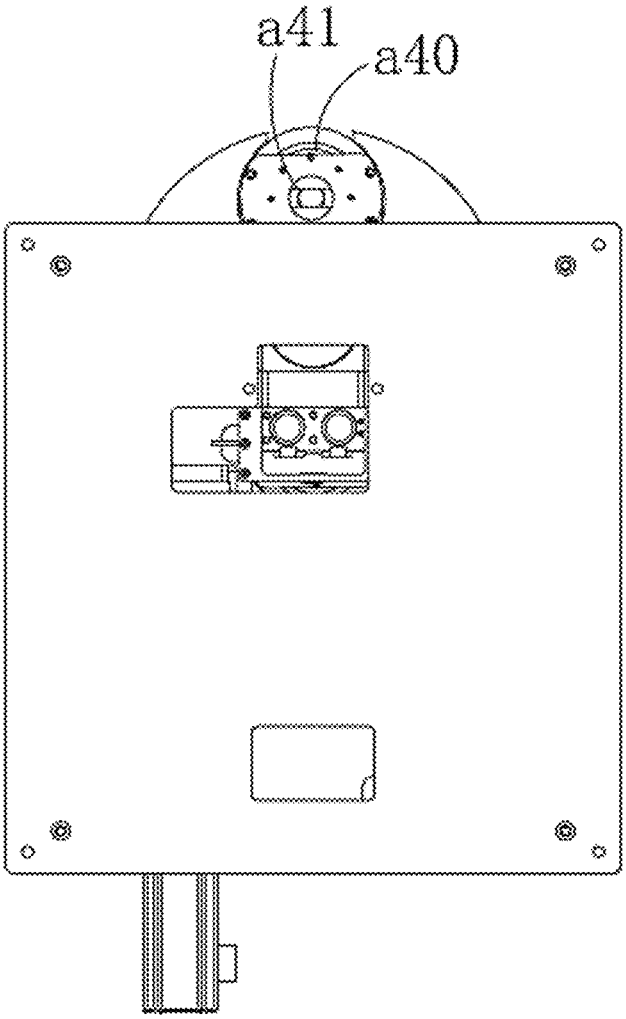
FIG. 7 illustrates an upward view of the rolling device according to the second embodiment of the disclosure.
Figure 8:
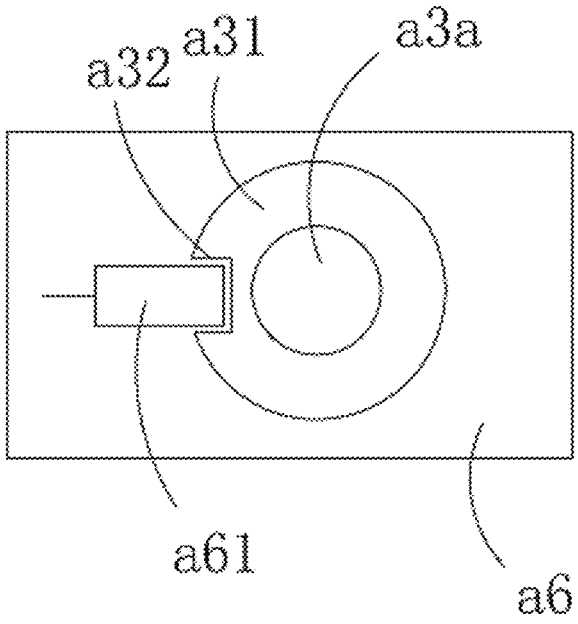
FIG. 8 illustrates a schematic structural diagram of sensor detection of the rolling device according to the second embodiment of the disclosure.
Figure 9:
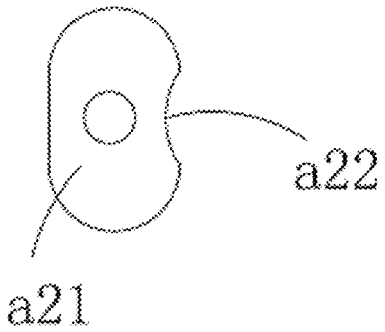
FIG. 9 illustrates a schematic structural diagram of a lower plate of the rolling device according to the second embodiment of the disclosure.
Figure 10:
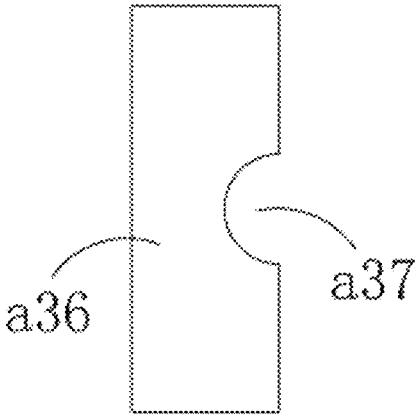
FIG. 10 illustrates a schematic structural diagram of a cantilever block of the rolling device according to the second embodiment of the disclosure.

As shown in FIGS. 6-8, the frame a1 is provided with at least one sensor fixing block a10 located outside the rotating power device a3, and a transversal surface of the sensor fixing block a10 is U-shaped. There are two sensor fixing blocks a10 in this embodiment, and the two sensor fixing blocks a10 are symmetrically distributed. The rotating power device a3 is located between the two sensor fixing blocks a10 to facilitate position detection. The frame a1 is provided with a position sensor a11 fixed on one of the sensor fixing blocks a10. The position sensor a11 is a photoelectric sensor. The rotating positioning blocks a30 which the number is equal to the total number of rolling cavity dies a4 are connected to the outside of the rotating power device a3, the rotating power device a3 drives the rotating positioning blocks a30 to rotate synchronously. When the position sensor a11 is opposite to any one rotating positioning block a30, it means that one of the rolling cavity dies a4 is directly below the pressing block a51. That is, when the position sensor a11 detects the signal of the rotating positioning block a30, it means that the rolling cavity die a4 rotates in place, and then the rolling operation can be carried out, ensuring the reliability of production and processing.

In an optimization scheme, the lifting seat a6 is a rectangular frame, the cavity die rotation power device a3*a* is a servo motor and the servo motor is located in the rectangular frame to form the protection of the servo motor, the upper end of the servo motor is fixed on the top side of the rectangular frame and the output shaft of the servo motor is upward through the top side of the rectangular frame, and a Y-shaped sensor a61 is arranged on the top surface of the rectangular frame, and the Y-shaped sensor a61 is a photoelectric position sensor, a linkage plate a31 is sleeved on the output shaft of the servo motor, and a notch a32 is provided on the linkage plate a31. When the Y-shaped sensor a61 enters the notch a32 of the linkage plate a31, the output shaft of the servo motor rotates in place. The above structure is mainly to ensure the matching accuracy of the clutch connection structure, so as to prevent the position deviation caused by the dislocation from realizing the clutch connection.

In an optimization scheme, the clutch connection structure includes a flat connector a33 arranged on the top of the output shaft of the servo motor, a clutch plate a40 is connected at the lower end of each rolling cavity die a4, and a flat hole a41 is arranged in a center of the clutch plate a40 for inserting the flat connector a33. The top of the flat connector a33 is provided with two conical surfaces, which form an inverted V-shaped surface to play a guiding role.

Furthermore, as shown in FIGS. 4-10, the rotating power device a3 includes a rotating cylinder, a rotating shaft a34 is connected to the rotating power device a3, a rotating shaft base a35 sleeved on the upper end of the rotating shaft a34 is disposed on the frame a1, the rotating table a2 is installed on the end surface of the rotating shaft a34 extended to the upper end of the rotating shaft base a35, a cantilever block a36 is disposed on a side of the rotating shaft base a35, and a support notch a37 is provided on the cantilever block a36, and the output shaft of the servo motor is snapped in the support notch a37. The support notch a37 plays a supporting and guiding role.

Furthermore, the rotating table a2 includes a strip-shaped plate a20, a middle position of the strip-shaped plate a20 is fixed on an upper end face of the rotating shaft a34, and two ends of the upper surface of the strip-shaped plate a20 are respectively provided with the above-mentioned rolling cavity dies a4. Specifically, the two ends of the strip-shaped plate a20 are respectively provided with mounting holes, and the above-mentioned rolling cavity dies a4 are rotatably installed in the mounting holes respectively. The clutch plate a40 is located in the mounting hole, the two ends of the lower surface of the strip-shaped plate a20 are respectively provided with a lower plate a21 located under the clutch plate a40, a center of the rotating shaft base a35 is provided with a shaft through hole, the upper end of the rotating shaft a34 is connected with a bearing group a38 and the bearing group a38 is installed in the shaft through hole, the middle position of the strip-shaped plate a20 is fixed at the upper end of the bearing group a38, and the two lower plates a21 are symmetrically arranged with the axis of the bearing group a38, and opposite inner edges of the two lower plates a21 are respectively provided with arc concave surfaces a22 matching with the outer wall of the bearing group a38. The arc concave surface a22 can improve the smoothness of rotation and can further improve the matching strength of the connection.

The bearing group a38 includes an upper fixing ring, a lower fixing ring, and a bearing piece installed between the upper fixing ring and the lower fixing ring. The arc concave surface a22 matches a circumferential direction of the lower fixing ring.

Furthermore, the upper surface of the strip-shaped plate a20 is provided with a disc plate a24, and an outer edge of the disc plate a24 is provided with circular opening grooves a25 for the rolling cavity dies a4 to extend. The disc plate a24 can form a guard.

In an optimization scheme, the translation driving device a8 includes a fixed groove a80 provided on the lower flat plate, two ends of the fixed groove a80 are closed, an upper side of the fixed groove a80 is provided with an opening and a guide rail a81 parallel to the fixed groove a80, the fixed groove a80 is connected with a servo motor a82, and a U-shaped sliding plate a83 closes the upper notch of the fixed groove a80 and forms an inverted U-shape, the servo motor a82 is connected with the U-shaped sliding plate a83 through a driving structure disposed in the fixed groove a80 to drive the U-shaped sliding plate a83 to move along the length direction of the fixed groove a80. Furthermore, the driving structure includes a drive screw rod connected to the output shaft of the servo motor a82, two ends of the drive screw rod are installed on the fixed groove a80 through bearings, and the drive screw rod is sleeved with a screw sleeve, the screw sleeve is installed on the lower surface of the U-shaped sliding plate a83 through the fixed seat. The matching of drive screw rod and screw sleeve can improve the control accuracy, and cooperate with the servo motor to accurately control the travel of the rolling terrace die a7.

The translation driving device a8 further includes a transverse translation plate a84, an end of which is fixed on the U-shaped sliding plate a83, the other end of which is connected with a sliding block a85 and the sliding block a85 is connected with the guide rail a81 in a sliding way, and the terrace die rotation driving device a70 is fixed on the transverse translation plate a84. The above structure can further improve the compactness of the layout.

Furthermore, the upper flat plate a13 is provided with an avoidance hole 130, the terrace die rotation driving device a70 is a servo motor and the servo motor part extends into the avoidance hole 130. This structure can further improve the compactness of the layout.

A forming method of pulp molded product includes the following steps.

S1, an unrolled pulp molded product is fixed on the rolling cavity die a4; the unrolled pulp molded product can be fixed on the rolling cavity die a4 by using a manipulator or manually.

S2, the rotating table rotates and drives the rolling cavity die a4 to enter directly under the pressing block a51; the rolling cavity die a4 corresponds to the rotating positioning block a30, that is, the position sensor a11 detects the signal of the rotating positioning block a30 opposite to the rolling cavity die a4 directly below the pressing block a51.

S3, the lifting power member a50 drives the pressing block a51 to lower and press the top of the pulp molded product.

S4, the lifting power device a60 drives the cavity die rotation power device a3*a* to rise, the cavity die rotation power device a3*a* and the rolling cavity die a4 are connected through the clutch connection structure, and the translation driving device a8 drives the rolling terrace die a7 installed on the terrace die rotation driving device a70 to move close to the rolling cavity die a4 directly below the pressing block a51;

that is, the Y-shaped sensor a61 enters into the notch a32, indicating that the position is in place.

S5, the cavity die rotation power device a3*a* drives the rolling cavity die a4 to rotate, the terrace die rotation driving device a70 drives the rolling terrace die a7 to rotate at the same time, and the rotation direction of the rolling cavity die a4 is opposite to the rotation direction of the rolling terrace die a7, and the translation driving device a8 drives the rolling terrace die a7 to be in contact with the outer wall of the pulp molded product and roll the pulp molded product.

S6, the rolled pulp molded product is transferred to the lower part of the pressing block by using the rotating table, and then the next unprocessed pulp molded product on the rotating table enter the lower part of the pressing block, the above steps S3-S5 are repeated, and at the same time, the rolled pulp molded product is unloaded, that is, the pulp molded product is prepared.

The air cylinder or oil cylinder in this embodiment is a double-rod air cylinder or a double-rod air oil cylinder.

As another embodiment, the working principle and structure of this embodiment are basically the same as that of Embodiment 1, but the different structure is that there are 3-6 rolling units D20.

As another embodiment, there is one rolling unit D20 and one take-and-place unit D8, and the unloading action is performed after the loading action.

As another embodiment, the structures of the edge cutting device C and the rolling device are basically the same as that of Embodiment 1, the edge cutting can be realized only by replacing the following: the translatable rolling wheel D2 is replaced with a translatable rotary cutter with circular shape, and the rolling moving die D5 is replaced with the rotary cutting moving die to improve the rotary cutting processing efficiency. The structure of the rotary cutting moving die is similar to that of the rolling moving die D5, the difference is that an avoidance groove on the rotary cutting moving die is in a more downward position, and when the translatable rotary cutter performs edge cutting, it enters the avoidance groove.

The specific embodiments described herein are only illustrative of the spirit of the disclosure. Those skilled in the related art can make various modifications or supplements to the specific embodiments described or use similar methods to replace them, but they will not deviate from the spirit of the disclosure or go beyond the scope defined in the appended claims.

What is claimed is:

1. A pulp molded product line with roll forming function, comprising:

a pulp suction device;

a hot pressing assembly, configured to perform hot pressing on a pulp sucked by the pulp suction device to obtain a hot pressed pulp molded product;

an edge cutting device, configured to perform edge cutting on the hot pressed pulp molded product obtained after the hot pressing of the hot pressing assembly to obtain an unrolled pulp molded product; and a rolling device, configured to perform radially inwards rolling on the unrolled pulp molded product obtained after the edge cutting of the edge cutting device to obtain a pulp molded product;

wherein an annular convex buckle is formed on an inner wall of the pulp molded product obtained after the rolling of the rolling device, and an annular rolling groove corresponding to the annular convex buckle is formed on an outer wall of the pulp molded product;

wherein the rolling device comprises:

a loading unit, configured to load and convey the unrolled pulp molded product;

a rolling unit, comprising a horizontal rotating table; wherein at least one translatable rolling wheel is horizontally slidably connected to an upper surface of the horizontal rotating table, the at least one translatable rolling wheel is connected to a translation driving mechanism and a rotation driving mechanism, the upper surface of the horizontal rotating table is rotatably connected to two rolling moving dies located at a periphery of each translatable rolling wheel and symmetrically distributed with the translatable rolling wheel as a center, a rotation direction of each of the two rolling moving dies is opposite to a rotation direction of the translatable rolling wheel, and rotation speeds of the rolling moving die and the translatable rolling wheel are the same; each rolling moving die corresponds to a rotary pressing-down assembly, each rolling moving die corresponds to a rotary driving mechanism, the rotary driving mechanism is configured to drive the rolling moving die to rotate, the translatable rolling wheel is configured to move close to the rolling moving die, thereby to radially inwards roll the unrolled pulp molded product, and a next unrolled pulp molded product is placed on another rolling moving die; and a take-and-place unit, configured to place the unrolled pulp molded product conveyed by the loading unit on the rolling moving die, and obtain and transfer the rolled pulp molded product out of the rolling unit; and wherein the pulp suction device and the hot pressing assembly are used to transfer the pulp through a first robot; and the edge cutting device and the rolling device are used to transfer the unrolled pulp molded product through a second robot.

2. The pulp molded product line with roll forming function according to claim 1, wherein the number of the rolling unit is two, the two rolling units are linearly distributed front and back at intervals, and the two rolling units are rotatably connected to a frame.

3. The pulp molded product line with roll forming function according to claim 2, wherein the number of the take-and-place unit is two, one of the two take-and-place units is located above the loading unit, the other take-and-place unit is located above an unloading unit, the one take-and-place unit is configured to place unrolled pulp molded products conveyed by the loading unit on the two rolling units in a one by one way, and the other take-and-place unit is configured to obtain and transfer pulp molded products rolled by the two rolling units to the unloading unit in a one by one way, the loading unit and the unloading unit are distributed in parallel, and the rolling units are located between the loading unit and the unloading unit.

4. The pulp molded product line with roll forming function according to claim 1, wherein the number of the at least one translatable rolling wheel is multiple, and the multiple translatable rolling wheels are arranged in a row, the rotation driving mechanism is configured to drive the translatable rolling wheels to rotate synchronously, the two rolling moving dies which are symmetrically distributed with the translatable rolling wheel as the center are distributed on the periphery of each translatable rolling wheel, the rolling moving dies are arranged in two rows, the number of the rotary driving mechanism is two, and one of the two rotary driving mechanisms is configured to drive the rolling moving dies located on a same raw to rotate synchronously, and the rotary pressing-down assemblies are distributed in two rows and located on a same row act synchronously.

5. The pulp molded product line with roll forming function according to claim 4, wherein each rotary pressing-down assembly comprises: a rotating cylinder and a pressing block connected to a rotating telescopic rod of the rotating cylinder, and the pressing block is rotatably connected to the rotating telescopic rod of the rotating cylinder.

6. The pulp molded product line with roll forming function according to claim 4, wherein the translation driving mechanism comprises a translation plate horizontally and slidably connected with the horizontal rotating table, each translatable rolling wheel is mounted on the translation plate through a connecting shaft and the connecting shaft is rotatably connected with the translation plate, and the horizontal rotating table is provided with a translation power assembly configured to drive the translation plate to move close to the rolling moving die or move facing away from the rolling moving die.

7. The pulp molded product line with roll forming function according to claim 6, wherein the rotation driving mechanism comprises a linkage synchronous belt wound on two adjacent connecting shafts, one the connecting shaft is connected with a driving motor through an active synchronous belt, and the driving motor is fixed on one of the translation plate and the horizontal rotating table.

8. The pulp molded product line with the roll forming function according to claim 4, wherein each rotary driving mechanism comprises a rotating synchronous belt wound on rolling rotating shafts connected with the rolling moving dies, the rotating synchronous belt is connected to a rotating servo motor fixed on the horizontal rotating table, and a section of the rotating synchronous belt wound on the rolling rotating shafts is wavy.

9. The pulp molded product line with the roll forming function according to claim 4, wherein the rotary pressing-down assemblies on one same row and the rotary pressing-down assemblies on the other same column are arranged in a staggered manner.

10. The pulp molded product line with roll forming function according to claim 3, wherein each take-and-place unit is installed on a gantry bracket, and a camera located at a loading end of the loading unit is arranged on an inner side of two ends of the gantry bracket; the take-and-place unit is connected to a lower side of a top of the gantry bracket through a translation driving device, and the translation driving device is configured to drive the take-and-place unit to translate, thereby to transfer the rolled pulp molded products to the unloading unit.

11. The pulp molded product line with roll forming function according to claim 10, wherein each take-and-place unit comprises a horizontally arranged triangular block, each corner of a lower surface of the triangular block is connected with an upper connecting block, a lower surface of each upper connecting block is connected with a connecting rod, lower ends of the connecting rods are inwards converged and connected to a lower connecting block, and a lower surface of the lower connecting block is connected with a material taking device.

12. The pulp molded product line with the roll forming function according to claim 1, wherein the edge cutting device comprises a horizontal rotating table, at least one translatable rotary cutter with circular shape is horizontally and slidably connected to an upper surface of the horizontal rotating table, the translatable rotary cutter with circular shape is connected with a translation driving mechanism and a rotation driving mechanism, the upper surface of the horizontal rotating table is rotatably connected with two rotary cutting moving dies located at a periphery of each translatable rotary cutter with circular shape and symmetrically distributed with the translatable rotary cutter with circular shape as a center, each rotary cutting moving die corresponds to a rotary pressing-down assembly, each rotary cutting moving die corresponds to a rotary driving mechanism, and the rotary driving mechanism is configured to drive the rotary cutting moving die to rotate, the translatable rotary cutter with circular shape moves close to one the rotary cutting moving die to radially inwardly cut a pulp molded product without edge cutting, and a next pulp molded product without edge cutting is placed on another rotary cutting moving die.

13. A pulp molded product line with roll forming function, comprising:

a pulp suction device;

a hot pressing assembly, configured to perform hot pressing on a pulp sucked by the pulp suction device to obtain a hot pressed pulp molded product;

an edge cutting device, configured to perform edge cutting on the hot pressed pulp molded product obtained after the hot pressing of the hot pressing assembly to obtain an unrolled pulp molded product; and a rolling device, configured to perform radially inwards rolling on the unrolled pulp molded product obtained after the edge cutting of the edge cutting device to obtain a pulp molded product, and the rolling device comprises a frame, a horizontally arranged rotating table is disposed on the frame, the rotating table is connected to a rotating power device, a plurality of rolling cavity dies are installed on the rotating table, each of the plurality of rolling cavity dies is rotationally connected to the rotating table and is configured to fix the pulp molded product, the plurality of rolling cavity dies are distributed in a circle, the frame is provided with a support and a lifting power member installed on the support, the lifting power member is connected to a pressing block, the pressing block is rotationally connected to the lifting power member, the rotating power member is configured to drive the rotating table to rotate to thereby make the plurality of rolling cavity dies alternately enter directly below the pressing block, the frame is provided with a lifting seat located under the rotating table and a lifting power device, the lifting power device is configured to drive the lifting seat to lift vertically, the lifting power device is provided with a cavity die rotation power device, the lifting power device is configured to drive the cavity die rotation power device to rise, a clutch connection structure is connected between the cavity die rotation power device and the rolling cavity die directly under the pressing block to realize the rotation of the rolling cavity die, the frame is further provided with a rolling terrace die, the rolling terrace die is relatively distributed with the rolling cavity die directly below the pressing block, the rolling terrace die is connected to a terrace die rotation driving device, and the terrace die rotation driving device is arranged on a translation driving device;

wherein an annular convex buckle is formed on an inner wall of the pulp molded product obtained after the rolling of the rolling device, and an annular rolling groove corresponding to the annular convex buckle is formed on an outer wall of the pulp molded product.

14. The pulp molded product line with the roll forming function according to claim 13, wherein the frame is provided with at least one sensor fixing block located on an outer side of the rotating power device and a position sensor fixed on one of the at least one sensor fixing block, the outer side of the rotating power device is connected with rotating positioning blocks with a number equal to a total number of the plurality of rolling cavity dies, the rotating power device is configured to drive the rotating positioning blocks to rotate synchronously, and when the position sensor is opposite to one of the rotating positioning blocks, it is indicated that one rolling cavity die is located under the pressing block.

15. The pulp molded product line with the roll forming function according to claim 13, wherein the lifting seat is a rectangular frame, the cavity die rotation power device is a servo motor, the servo motor is located in the rectangular frame, an upper end of the servo motor is fixed to a top side of the rectangular frame, an output shaft of the servo motor upwards penetrates through the top side of the rectangular frame, a Y-shaped sensor is arranged on a top surface of the rectangular frame, the output shaft of the servo motor is sleeved with a linkage plate, a notch is provided on a linkage plate, and when the notch of the linkage plate enters a sensing range of the Y-shaped sensor, it is indicated that the output shaft of the servo motor rotates in place.

16. The pulp molded product line with the roll forming function according to claim 15, wherein the clutch connecting structure comprises a flat connector arranged at a top of the output shaft of the servo motor, a clutch plate is connected to a lower end of each rolling cavity die, and a flat hole allowing the flat connector to be inserted is formed in a center of the clutch plate; and wherein the rotating power device is a rotary air cylinder, a rotating shaft is connected to the rotating power device, a rotating shaft base sleeved at an upper end of the rotating shaft is arranged on the frame, the rotating table is installed on an end face of the rotating shaft extended to the upper end of the rotating shaft base, a cantilever block is arranged on a side of the rotating shaft base, a support notch is formed in the cantilever block, and the output shaft of the servo motor is snapped in the support notch.

17. The pulp molded product line with the roll forming function according to claim 16, wherein the rotating table comprises a strip-shaped plate, a middle position of the strip-shaped plate is fixed to an upper end face of the rotating shaft, and the rolling cavity dies are arranged at two ends of an upper surface of the strip-shaped plate respectively; and wherein the two ends of the upper surface of the strip-shaped plate are respectively provided with mounting holes and the rolling cavity dies are rotatably mounted in the mounting holes, the clutch plate is located in the mounting hole, two ends of a lower surface of the strip-shaped plate are respectively provided with two lower plates under the clutch plate, a center of the rotating shaft base is provided with a shaft through hole, the upper end of the rotating shaft is connected with a bearing group and the bearing group is mounted in the shaft through hole, the middle position of the strip-shaped plate is fixed at an upper end of the bearing group, and the two lower plates are symmetrically arranged with an axis of the bearing group and opposite inner edges of the two lower plates are respectively provided with arc concave surfaces matching with an outer wall of the bearing group.

18. The pulp molded product line with the roll forming function according to claim 17, wherein the upper surface of the strip-shaped plate is provided with a disc plate, and an outer edge of the disc plate is provided with circular opening grooves for the rolling cavity dies to extend in a one-to-one manner; and wherein the frame comprises a lower flat plate, the lower flat plate is connected to an upper flat plate through four stand columns, the lower flat plate is parallel to the upper flat plate, the rotating table is rotationally connected to the lower flat plate, the translation driving device is fixed to the upper flat plate, the lifting power device is fixed to the lower flat plate, the support is fixed to the lower flat plate, and the terrace die rotation driving device and the translation driving device are installed on the lower flat plate.

19. The pulp molded product line with the roll forming function according to claim 18, wherein the translation driving device comprises a fixing groove provided on the lower flat plate and a guide rail parallel to the fixing groove, an end of the fixing groove is connected to a first servo motor, a U-shaped sliding plate closes an upper notch of the fixed groove and forms an inverted U-shape, the first servo motor is connected with the U-shaped sliding plate through a driving structure arranged in the fixing groove so as to drive the U-shaped sliding plate to move in a length direction of the fixing groove, the translation device further comprises a transverse translation plate, an end of the transverse translation plate is fixed on the U-shaped sliding plate, the other end of the transverse translation plate is connected with a sliding block, the sliding block is slidably connected with the guide rail, and the terrace die rotation driving device is fixed on the transverse translation plate; and wherein the upper flat plate is provided with an avoidance hole, the terrace die rotation driving device is a second servo motor, and the second servo motor part extends into the avoidance hole.

* * * * *